US005933066A

United States Patent [19]

Chontas et al.

[11] Patent Number: 5,933,066

[45] Date of Patent: Aug. 3, 1999

[54] CIRCUIT INTERRUPTER WITH TERMINAL SHIELD AND WIRE TROUGH

[75] Inventors: Trent A. Chontas, East Pittsburgh; Keith L. Mayhood; Todd M. Lathrop, both of Pittsburgh, all of Pa.

[73] Assignee: Eaton Corporation, Cleveland, Ohio

[21] Appl. No.: 08/969,557

[22] Filed: Nov. 13, 1997

[51] Int. Cl.[6] ..... H01H 9/02

[52] U.S. Cl. ..... 335/202; 218/77; 218/97; 218/155

[58] Field of Search ..... 335/8, 9, 10, 16, 335/132, 202; 200/295–305; 218/89, 97, 77, 155

[56] References Cited

U.S. PATENT DOCUMENTS 5,150,091 9/1992 Hart et al. ..... 335/202
5,321,378 6/1994 Ferullo ..... 335/202

*Primary Examiner*—Lincoln Donovan
*Attorney, Agent, or Firm*—Martin J. Moran

[57] ABSTRACT

A molded case circuit breaker or switch having the LOAD and/or LINE terminals thereof protected by a multifunctional terminal shield arrangement which also provides interphase barriers for the aforementioned terminals and associated wiring. The barrier also provides wire channels for lower voltage supplemental wiring.

4 Claims, 4 Drawing Sheets

CIRCUIT INTERRUPTER WITH TERMINAL SHIELD AND WIRE TROUGH

CROSS RELATION TO PENDING APPLICATIONS

The subject matter of this invention is related to previously filed application Ser. No. 08/864,100 entitled "Combined Wire Lead and Interphase Barrier for Power Switches" filed May 28, 1997.

BACKGROUND OF THE INVENTION

1. Field of the Invention

The subject matter of this invention is related generally to molded case circuit breakers and more particularly to terminal shield arrangements for molded case circuit breakers.

2. Description of the Prior Art

Molded case circuit breakers are known generally in the art. As an example, U.S. Pat. No. 4,644,120 entitled "Molded Case Circuit Breaker with a Movable Lower Electrical Contact Positioned by a Torsion Spring" issued Feb. 17, 1987 and now transferred to the present assignee, teaches a molded case circuit breaker of the kind having terminals at each end thereof for interconnection with load and line conductors of a given voltage which may be, for example, voltages such as 120 or 240 volts ac. In addition there are provided on many molded case circuit breakers openings or ports through which relatively low voltage control or accessory wiring is provided. The relatively low voltage accessory wiring, which may be 10, 12 or 40 volts for example, is routed out of the molded case circuit breaker to other positions for providing electrical conductivity to and from the molded case circuit breaker. One of the disadvantages of having the relatively low voltage control or auxiliary wiring is the fact that it may be routed in or near the load or line wiring which is at a relatively higher voltage. As can be appreciated, even though the wires are insulated, having voltages of different values conducted by conductors in close proximity to each may introduce an opportunity for short circuit, flash over and other inadvertent electrical contact, etc. This would be detrimental to either the load, line or the low voltage auxiliary elements depending upon the circumstances.

It would be advantageous therefore if a means could be provided, which both shields the relatively high voltage terminals from outside contact and which acts as a separate wire way or wire routing device for low voltage or auxiliary voltage wiring, so that lower voltage and higher voltage can be appropriately spaced from each other by the insulation of the terminal shield and wire way arrangement.

SUMMARY OF THE INVENTION

In accordance with the invention a switching apparatus for an electrical power circuit is taught. The switching apparatus includes a switch housing and a switching device mounded within the switch housing. Power terminals are provided for connecting the switching device to an electrical circuit. The power terminals are at the face of the switch housing and dispose in space relationship therein. An attachment device is connecting in the housing to the switching device and has external leads exiting the switch housing adjacent to power terminals. A terminals shield is provided which is interconnected with the housing adjacent to the power terminals for shielding the power terminals and furthermore for having interphase barrier therein for separating the power terminals, one from the other and finally for having longitudinally extending passages therein through which the aforementioned low voltage electrical leads are routed.

BRIEF DESCRIPTION OF THE DRAWNGS

Reference may be had to the preferred embodiment of the invention shown in the accompanying drawings in which.

DESCRIPTION OF THE PREFEREED EMBODIMENTS

Figure 1:
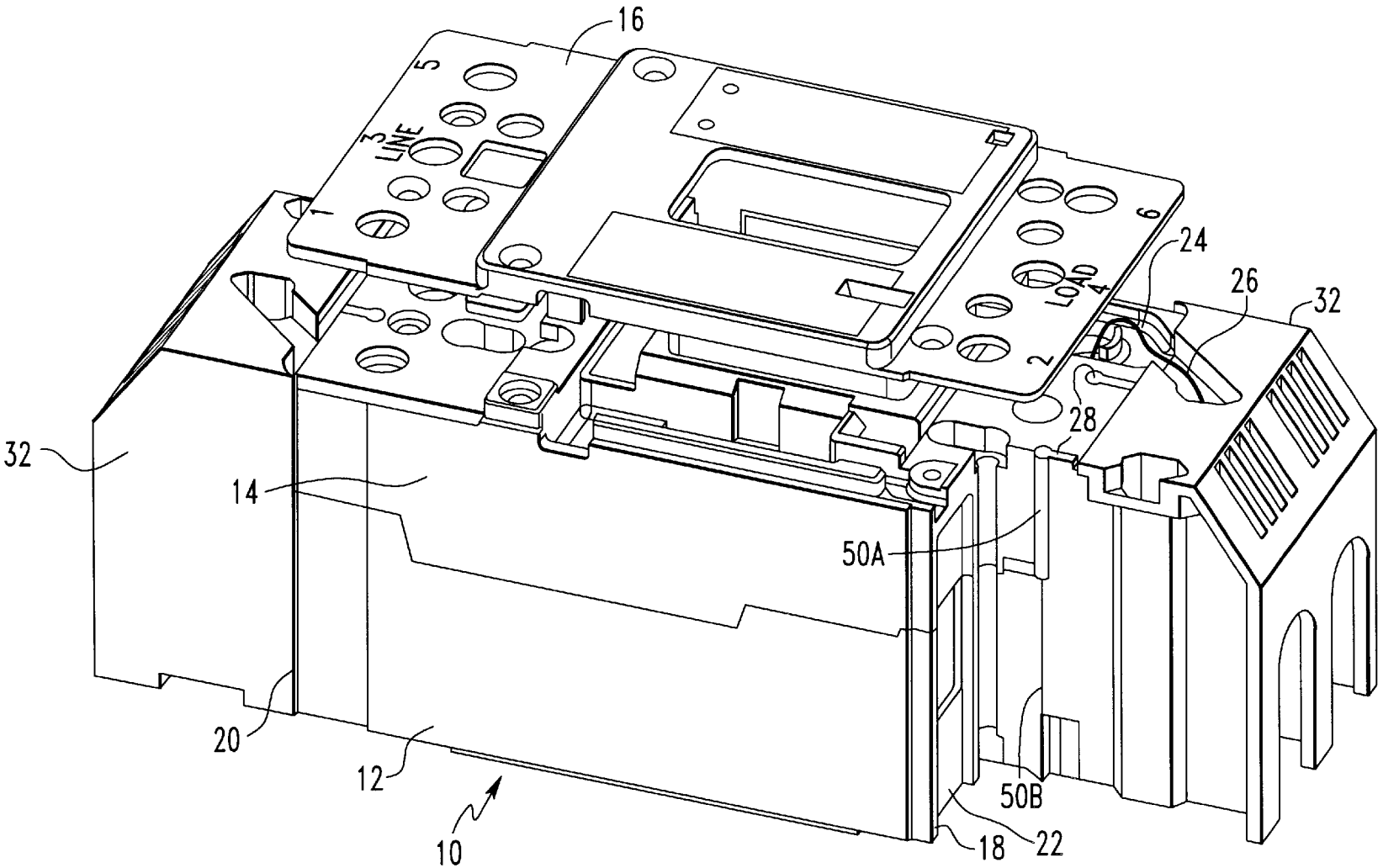
FIG. 1 shows a molded case circuit breaker and terminal shields in orthogonal projection partially broken away with openings and terminals for power leads and auxiliary leads and including slots for accepting the terminal shield.

Referring now to FIG. 1, molded case circuit breaker 10 with two partially broken away end shields 32 is depicted. Molded case circuit breaker 10 is of the type shown and described in U.S. Pat. 4,644,120 originally assigned to the Westinghouse Electric Corporation and now assigned by Agreement to the assignee of the present invention and incorporated herein by reference. In particular, molded case circuit breaker 10 may included a lower housing 12 and an upper housing 14 which together join to form an enclosure for enclosing standard molded case circuit breaker parts, such as trip mechanisms, operating mechanisms, and separable main contacts all of which are described in the previously mentioned incorporated-by-reference patent. There may also be provided a top cover or auxiliary cover 16 which fits on top of the top portion 14. Circuit breaker 10 may include openings 18 on one end thereof and 20 on the other end thereof which provide access to LOAD and LINE terminals 22 (not shown). There may be also provided at least one opening 24 extended into the internal region of the circuit breaker from which secondary, accessory or low voltage control wiring 26 may extend. There are provided in the circuit breaker case on the front and back (not shown) two longitudinal, stepped openings 28 which may be utilized for mounting the terminal the shield apparatus 32 in a manner which will be described herein after.

Figure 4:
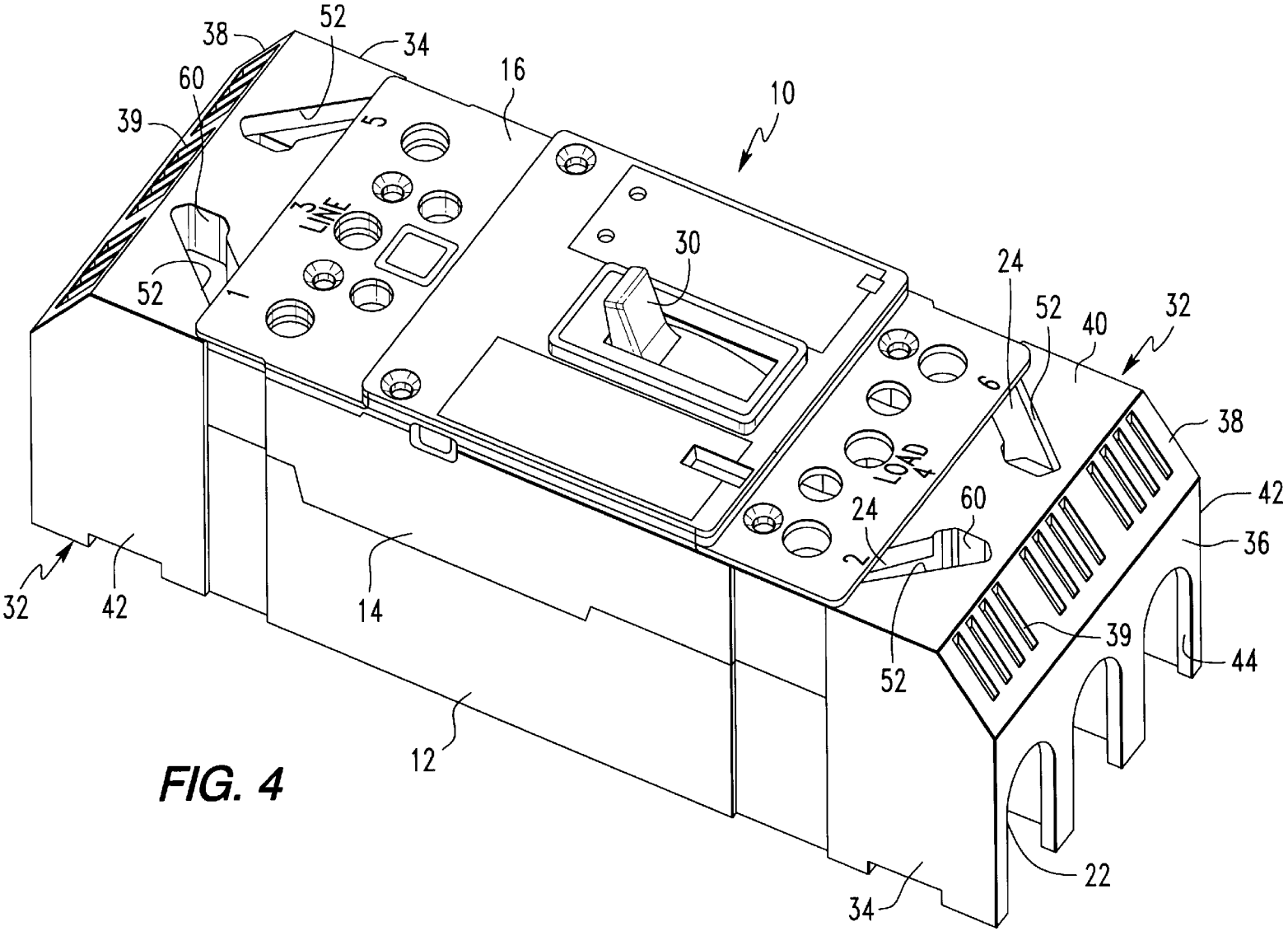
FIG. 4 shows an orthogonal view of the molded case circuit breaker with terminal shields fully in place on both ends thereof.
Figure 5:
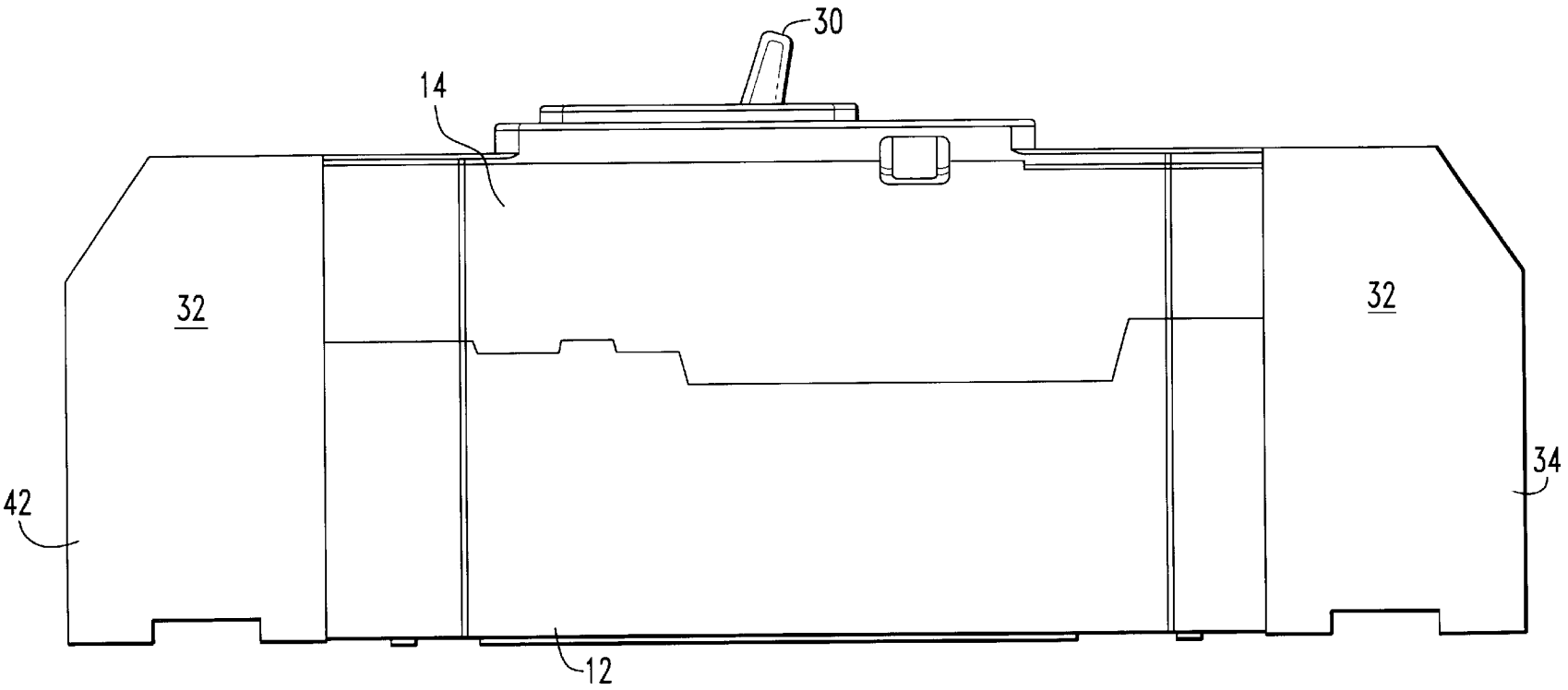
FIG. 5 shows the circuit breaker and terminal shield arrangement of FIG. 4 in side elevation.

There is provided on the top of the case protruding through an opening therein a handle 30 (see FIGS. 4 and 5). The handle 30 may be in the ON, OFF or RESET state, depending upon the status of mechanisms within the circuit breaker 10.

Figure 2:
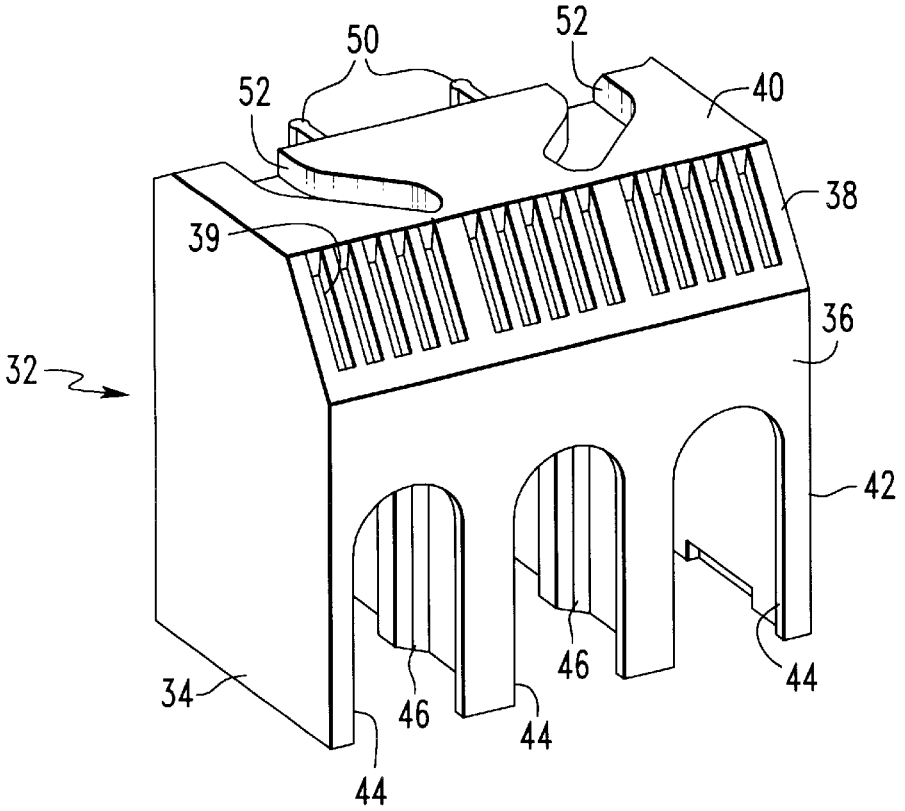
FIG. 2 shows the terminal shield of the present invention in orthogonal view from the non-circuit breaker side thereof.
Figure 3:
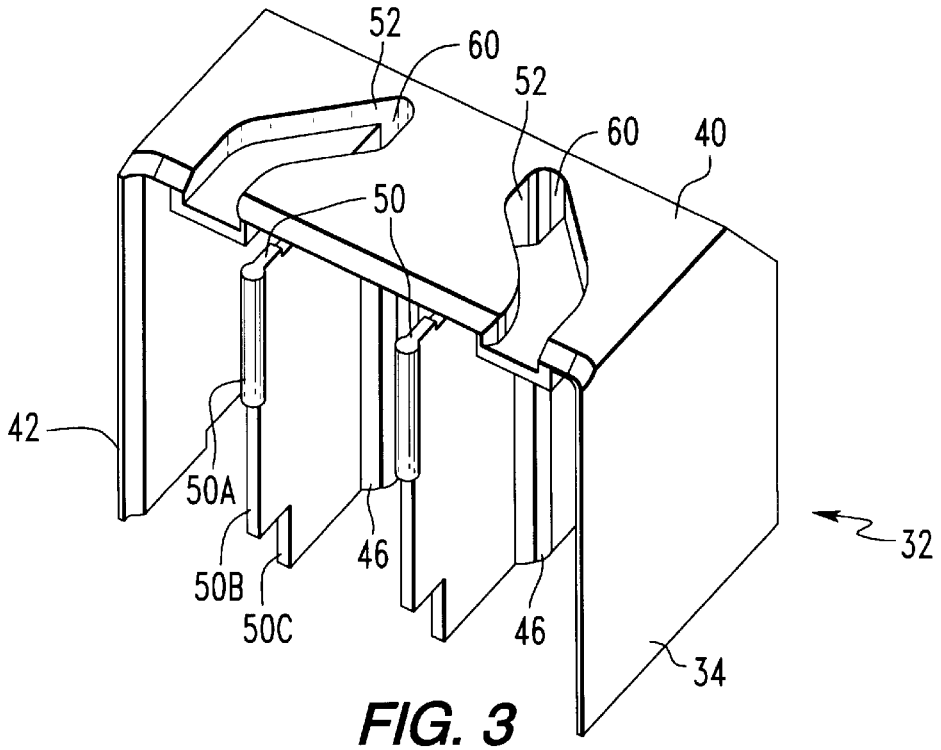
FIG. 3 shows an orthogonal view of the terminal shield of FIG. 2 from the side which is normally interconnected with the circuit breaker.

Referring now to FIGS. 2 and 3, there is shown a combination terminal shield-interphase barrier and wire control channel or trough 32. Shield arrangement 32 includes a set of parallel spaced apart side walls 34 and 42 which generally align with the sides of the circuit breaker 10 at the ends thereof. There is provided a transverse barrier on back wall 36 joining the side walls 34 and 32. Back wall 36 is generally parallel to the ends of the circuit breaker 10. A canted wall portion 38 traverses the region between the side walls 34 and 42 and joins the end region 36 with a transverse top wall 40. Canted wall region 38 has slots or openings 39 therein which may be utilized to conduct heat away from the main terminals 22 (not shown) protected by the shield 32. There are provided in the transverse panel or wall 36 openings 44 which extend from the bottom thereof to semicircular arc regions on the top. It is through these openings 44 that the main electrical conductors for the LOAD or the LINE terminals 22 may protrude after connection has been made. There is also shown two interphase barriers 46 that separate the regions of the three conductors which protrude through the openings 44, as would normally be he case in a three phase electrical system. There are provided on the opposite side of the shield from the end wall 36 two stepped longitudinal tabs 50 having a first extending tab region 50A, a stepped down tab region 50B, and a further stepped down tab region 50C. Tabs 50A and B align with the corresponding portions of openings 28 on the top 14 and bottom 12 of the molded case circuit breaker, such that tab 50A extends into the top portion of the circuit breaker 14 and tab 50B extends into the bottom portion of the circuit breaker 12 as shown in FIG. 1. There also provided two wire control channels 52 which align with the openings 24 in the circuit breaker 10 for having control wires 26 feed therethrough to transverse openings 60 in the interphase barriers 46, so that the wires may be routed through the transverse openings 60 via channels 52 to the bottom of the shield 32 and outwardly to control apparatus, power supplies, meters etc., for the low voltage wiring 26. The presence of the control wiring 26 in the channel 52 and the wire troughs 60 isolates the low voltage control wiring from the high voltage line or load wiring which protrudes transversally through the openings 44 on the shield 32 for jointure to the LOAD or LINE terminals in the regions 22 as the case may be.

Referring now to FIGS. 4 and 5 the molded case circuit breaker 10 of figure one is shown with two complimentary shield members 32 at each end thereof to form the fully constructed, double shielded, molded case circuit breaker arrangement depicted in FIGS. 4 and 5. With regard to FIGS. 4 and 5 the reference characters depicted therein are defined in FIGS. 1 through 3.

It is to be understood with the respect to the embodiments of this invention, that the shield arrangement is not limited to a 3-phase, ac shield arrangements. Nor is it required that there be a shield arrangement at both ends of the circuit interrupter as shown in FIGS. 4 and 5. It is also to be understood that the shield arrangement may be utilized even if there is no control wiring 26 present or if the control wiring 26 is utilized in a different part of the circuit breaker to follow a different exit route. It is also to be understood that the shield arrangement though described with respect to a molded case circuit breaker may be utilized with any electrical apparatus in which it is desired to shield the terminals thereof and/or provide interphase barriers and/or provide alternate safe routing for wiring of a different voltage level from the main load wiring.

The apparatus taught herein has many advantages. One of the advantages lies in the fact that a single shield arrangement may be utilized to provide the three fold function of: Main terminal protection, interphase barrier protection and alternate wiring channels for lower voltage wiring.

We claim:

1. Switching apparatus for an electric power circuit comprising:

a switch housing;

a switching device mounted in said switch housing;

power terminals for connecting said switching device to said electric power circuit mounted in spaced relation at an end face of said switch housing;

an attachment device connected in said housing to said switching device and having external leads exiting said switch housing adjacent said power terminals;

a terminal shield means interconnected with said housing adjacent said power terminals for shielding said power terminals;

said terminal shield means having interphase barriers separating said power terminals one from the other; and said interphase barriers having a longitudinally extending passage through which said electrical leads are routed.

2. The combination as claimed in claim 1, wherein said shield means has a wire trough therein disposed between said longitudinally extending passage and said end face.

3. The combination as claimed in claim 2, wherein said trough is oriented ninety degrees offset relative to said longitudinal passage.

4. Switching apparatus for an electric power circuit comprising:

a switch housing;

a switching device mounted in said switch housing;

power terminals for connecting said switching device to said electric circuit mounted in spaced relation at an end face of said switch housing;

leads exiting said switch housing adjacent to but not connected to said power terminals;

a terminal shield means interconnected with said housing adjacent said power terminals for shielding said power terminals;

said terminal shield means having interphase barriers separating said lower terminals one from the other; and said interphase barriers having a longitudinally extending passage through which said electrical leads are routed.

* * * * *